United States Patent [19]

Clark

[11] 4,099,352

[45] Jul. 11, 1978

[54] VAULTED STRUCTURE

[76] Inventor: William T. Clark, P.O. Box 885, Jackson, Miss. 39205

[21] Appl. No.: 725,934

[22] Filed: Sep. 23, 1976

[51] Int. Cl.[2] ..... E04B 1/32

[52] U.S. Cl. ..... 52/80; 52/82; 52/199; 52/409

[58] Field of Search ..... 52/80, 81, 82, 86, 409, 52/199

[56] References Cited

U.S. PATENT DOCUMENTS

| | | | |
|---|---|---|---|
| 416,364 | 12/1889 | Hough | 52/80 |
| 2,187,616 | 1/1940 | Cowin | 52/81 |
| 2,733,784 | 2/1956 | Berry | 52/86 |
| 2,753,818 | 7/1956 | Green | 52/80 |
| 2,769,409 | 11/1956 | Ratten | 52/81 |
| 2,955,686 | 10/1960 | Blomeley | 52/81 |
| 3,086,323 | 4/1963 | Pine | 52/199 |
| 3,257,930 | 6/1966 | Averna | 52/199 |
| 3,381,422 | 5/1968 | Olson | 52/81 |
| 3,748,803 | 7/1973 | Widerby | 52/199 |

FOREIGN PATENT DOCUMENTS

| | | | |
|---|---|---|---|
| 600,535 | 4/1948 | United Kingdom | 52/81 |

*Primary Examiner*—Price C. Faw, Jr.
*Assistant Examiner*—Henry Raduazo
*Attorney, Agent, or Firm*—Dennison, Dennison, Meserole & Pollack

[57] ABSTRACT

A vaulted structure of exceptional strength and rigidity is disclosed, characterized by a box-section construction of a plurality of radially spaced-apart sheet material gores joined by radially-extending members that coact with the gores to provide rigidifying and ventillation plenum forming means whereby the expansion-contraction characteristics of the structure are controlled to minimize thermal distortion. In a preferred embodiment the structure is in the form of a generally hemispherical dome formed of sheet metal gores.

13 Claims, 12 Drawing Figures

10
14
16
18
20
22
24
26
28
30
44
50
56
62
70
76
78
80
82
84
94
96
98
100
102
104
106
108
90
38
11
55
57
74
52

VAULTED STRUCTURE

BACKGROUND OF THE INVENTION

This invention relates generally to vaulted structures formed of sheet material and devoid of any significant internal bracing so as to provide a structure having a substantially unobstructed interior whereby the structure may be utilized for numerous purposes.

Vaulted structures of the nature described are shown, for example in U.S. Pat. No. 3,359,682, Dec. 26, 1967 which is exemplary of structures shown in other patents, namely, U.S. Pat. Nos. 3,245,178; 3,387,356; and 3,594,964, also directed to structures having substantially unobstructed interiors and directed primarily to observatory and planetarium projection domes.

Such prior art vaulted structures while being satisfactory for the intended purpose have been found to, for example, have expansion-contraction characteristics and sound transmission characteristics that, while not detracting from the structural integrity or utility of the structure, may be somewhat less than ideal.

In this regard, prior art vaulted or domed structures of the nature described are frequently provided with interiorly disposed skeletal structures to which an outer skin of sheet metal is rigidly secured. U.S. Pat No. 3,387,356, previously mentioned is directed to a method of assembling an observatory dome that is relatively light weight, but still of sufficient structural strength, without the necessity of utilizing a massive skeletal supporting structure. It will be appreciated from consideration of the disclosure therein that a vaulted structure produced by the method disclosed is of sufficient rigidity for the intended purpose and does include some means to provide expansion-contraction of the dome components, but does not show or suggest means for significantly enhancing the rigidity of a vaulted structure while at the same time minimizing thermal distortion thereof and substantially reducing noise transmission from the exterior of the structure to the interior of the structure.

SUMMARY OF THE INVENTION

This invention is directed to the provision of a vaulted structure of exceptional strength and rigidity which is characterized by a box-section construction comprising a plurality of radially spaced-apart sheet material gores joined by radially-extending members that coact with the gores to provide rigidifying and ventillation plenum means whereby the expansion-contraction characteristics and sound transmission characteristics of the structure are controlled to minimize thermal distortion.

In a preferred embodiment the vaulted structure is in the form of a generally hemispherical dome formed of sheet metal gores. It is also contemplated that a vaulted structure in accordance with the present invention can be in the form of a vaulted structure having the configuration of a cloister, or generally A-frame configuration.

Vaulted structures constructed in accordance with the present invention provides a box-section construction that substantially increases the overall structural integrity over that of the prior art.

In addition, vaulted structures produced in accordance with the present invention provide positive gravity ventillation to substantially the entire structure by virtue of plenum means formed by exterior and interior skin members.

Another significant aspect of the invention resides in providing a vaulted structure, such as a generally hemispherical observatory or planetarium dome with improved means for insulating the structure to control expansion-contraction in a predetermined manner to minimize thermal distortion and also substantially reduce noise transmission from the outer skin of the structure to the interior thereof.

These together with other advantages which will become subsequently apparent reside in the details of construction as more fully hereinafter described and claimed.

BRIEF DESCRIPTION OF THE DRAWINGS

Reference is hereby made to the accompanying drawings forming a part hereof, wherein like numerals refer to like parts throughout, and in which.

Figure 1:
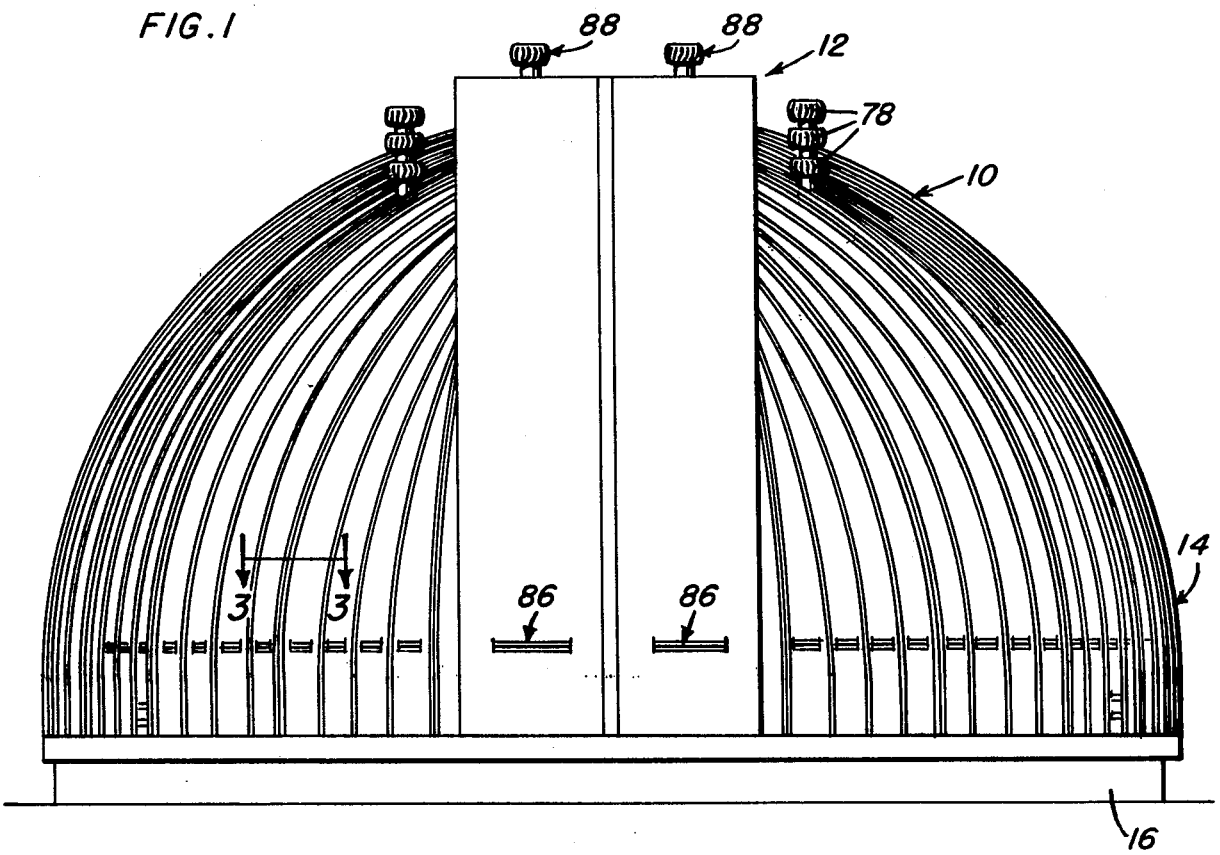
FIG. 1 is a front elevational view of a generally hemispherical dome structure or the like, provided with a shutter assembly.

Referring now to the figures, and more particularly to the embodiments in the invention illustrated in the drawings, it will be noted that a vaulted structure indicated generally by the numeral 10 is of a generally hemispherical dome configuration provided with a shutter assembly indicated generally at 12 such as conventionally provided with respect to observatory domes to permit a selective opening or closing of the sighting aperture in the dome so as to facilitate the sighting of a telescope or the like through the opening so provided. It will be appreciated that the shutters indicated generally at 12 are illustrated in a closed position. Aside from several structural details to be discussed more fully hereinbelow the vaulted, or domed structure illustrated in FIGS. 1 and 2 has an external appearance somewhat analogous to that of the dome structures shown in one or more of the aforementioned prior art patents.

Figures 4, 5, 6, 8, 9, 10, 11:
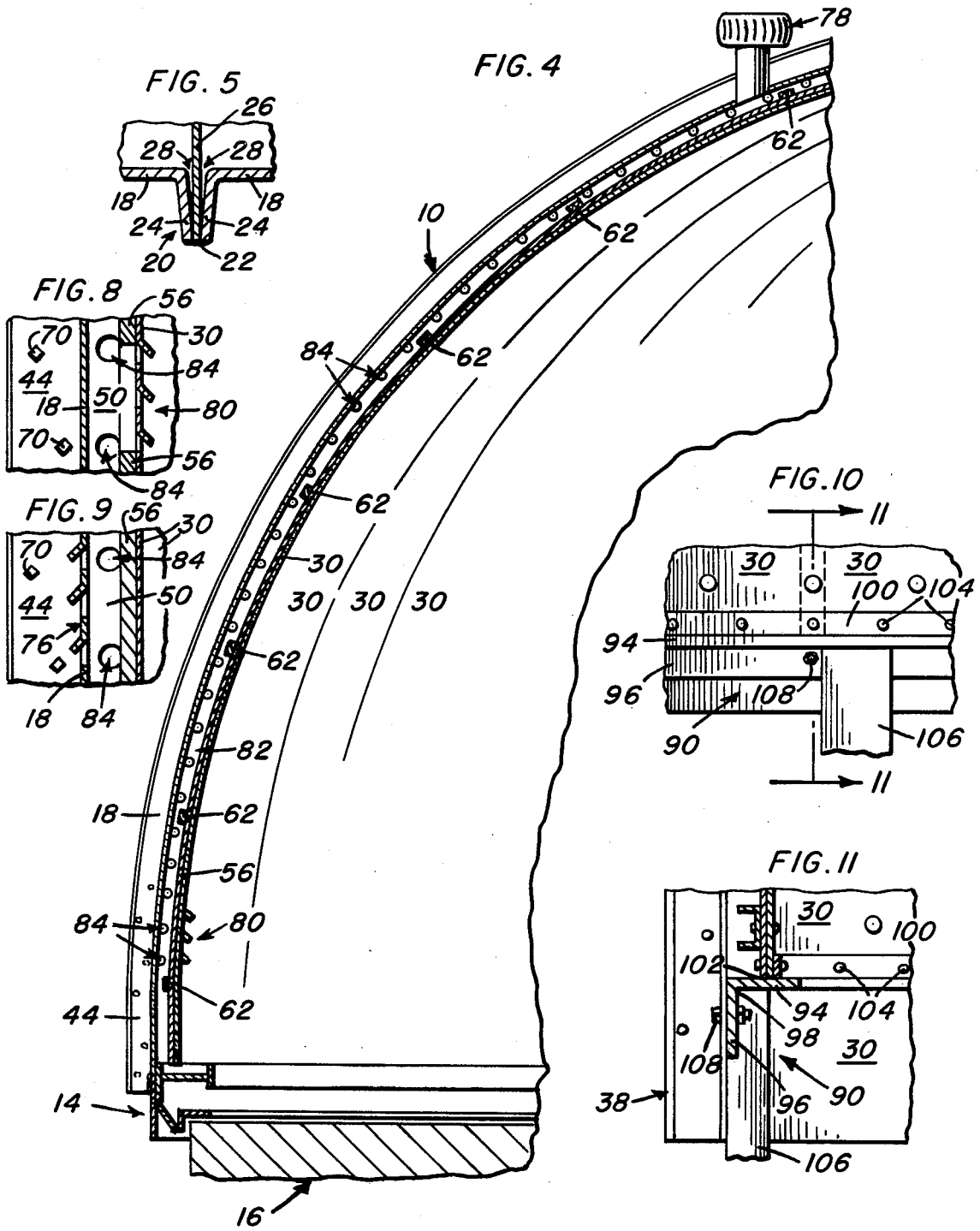
FIG. 4 is an enlarged vertical sectional view taken substantially along the plane of the line 4—4 of FIG. 2.
FIG. 5 is an enlarged fragmentary view of a portion of the structure illustrated in FIG. 3.
FIG. 6 is an enlarged fragmentary view of specific structural features of the box-section construction of FIG. 3.
FIG. 8 is an enlarged fragmentary view of a portion of a vaulted structure of FIG. 4.
FIG. 9 is an enlarged fragmentary vertical sectional view taken substantially along the plane of the line 9—9 of FIG. 1.
FIG. 10 is a fragmentary elevational view of a modified support means for the box-section structure.
FIG. 11 is a vertical sectional view taken along the plane of the line 10—10 of FIG. 10.

Turning briefly to FIG. 4 attention is directed to the spring-line region of the dome indicated generally at 14, and it will be appreciated that the details relevant to rotatably supporting a vaulted structure such as the generally hemispherical dome 10 on a support base as indicated generally at 16 is not illustrated herein since it does not comprise a portion of this invention and reference may be had to support means as shown in the exemplary prior art patents referenced above.

Figure 7:
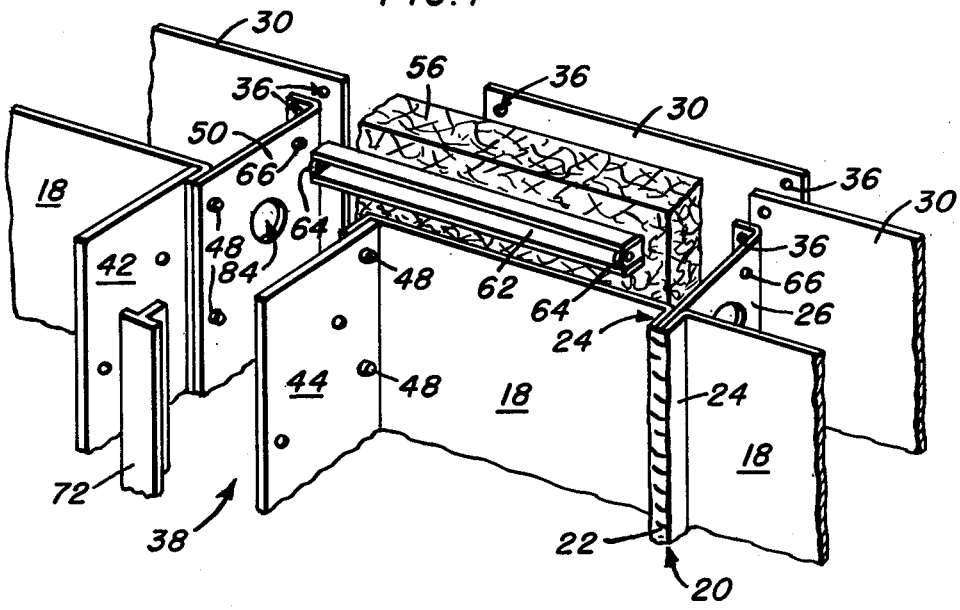
FIG. 7 is an enlarged fragmentary partially exploded view of an exemplary box-section structure for producing a vaulted structure.
Figure 3:
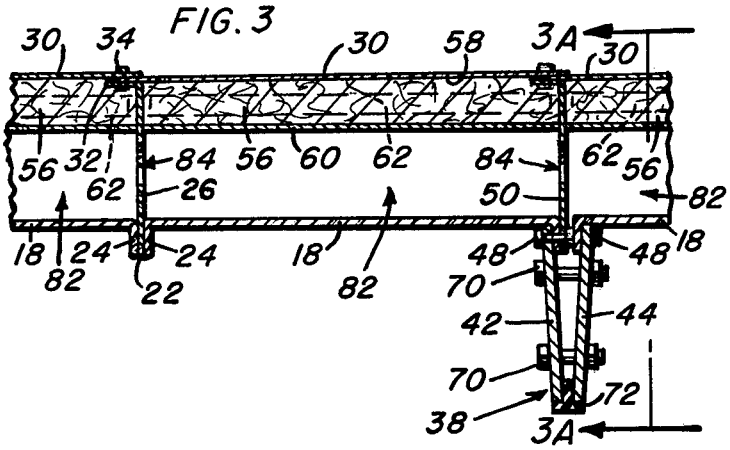
FIG. 3 is an enlarged fragmentary horizontal sectional view taken substantially along the plane of the line 3—3 of FIG. 1.
Figure 3A:
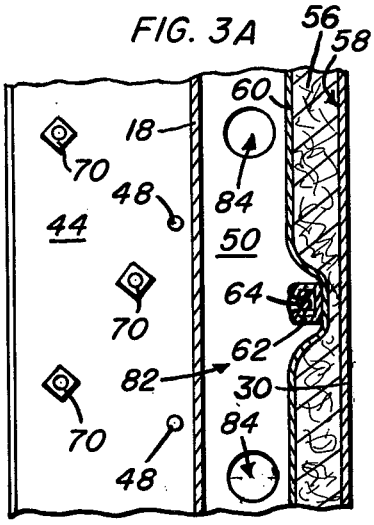
FIG. 3A is an enlarged fragementary vertical sectional view taken substantially along the plane of the line 3A—3A of FIG. 3.

The insulated box-section construction for a vaulted structure, such as the exemplary hemispherical dome 10 may initially best be appreciated from a consideration of FIG. 3, and the section line 3—3 of FIG. 1, together with FIGS. 3A and 7. Turning specifically to FIG. 3 the box-section construction illustrated therein comprises exterior skin gore sections 18, one of which is illustrated in its full transverse width and two of which are shown in a fragmentary manner. Two of the exterior gore sections 18 are illustrated as being joined, as indicated generally at 20, see also FIG. 5, by a continuous weld 22, at the outwardly turned exterior skin portions 24 and wherein a radially extending flange member 26 is interposed between the exterior skin portions 24 and fixed relative thereto by the weld bead 22 to provide an expansioncontraction joint as best seen from a consideration of FIG. 5, wherein it will be appreciated that as generally indicated at 28 adjacent exterior skin gores 18 are capable of generally linear expansion-contraction movement as schematically indicated by the double headed arrows in FIG. 5. The joint indicated generally at 20 is generally a "shop joint" and in this regard attention is directed to aforementioned U.S. Pat. No. 3,387,356 with regard to a somewhat analogous method of joining adjacent skin gore members although the aforementioned patent does not contemplate the provision of radially extending flanges such as the flanges 26.

As best seen from a consideration of the left-hand portion of FIG. 3 the box-section construction illustrated therein further includes interior skin gores 30 which in the embodiment illustrated therein are fixed radially inward of the exterior skin gores 18 by the provision of a laterally extending portion 32 of the flange member 26 and wherein adjacent interior skin gore members 30 are secured by mechanical fastener means such as exemplified by a rivet 34 passing through suitable apertures indicated generally at 36 and best seen in FIG. 7, in which figure the rivet 34 is not illustrated. It will thus be appreciated that spaced-apart securement of the exterior skin gores 18 and interior skin gores 30 in spaced-apart relation by the flange member 26 in the manner described generally provides the basic joint "module" that cooperates to enable construction of a vaulted structure having the substantially increased rigidity of the structure of the present invention.

Before discussing the structural elements and details relevant to other advantages derived from the present invention, attention is directed to a second type of joint indicated generally at 38 that may be characterized as a field or construction joint. It will be appreciated that to facilitate construction, and particularly shipments of vaulted structures produced in accordance with the present invention, it is preferable that a structure such as the dome 10 be prefabricated in sections as generally indicated at 40 within a manufacturing facility so as to insure that a vaulted structure produced in accordance with the invention conforms to specifications, and equally importantly facilitates the on-site construction of vaulted structures by substantially eliminating the necessity for any on-site welding. This is particularly advantageous when the material utilized for the interior and exterior skin gores normally require inert gas welding techniques. It is best seen from a consideration of the lower left-hand corner of FIG. 2 in the exemplary embodiment illustrated therein the dome 10 is comprised of a plurality of prefabricated modules 40 consisting of four exterior skin gores 18 joined by three shop joints 20 and wherein adjacent modules 40 are joined by field or construction joints 38. The field joints 38 are comprised of field joint plates 42 and 44 fixed to outwardly turned portions 46 of the exterior gore sections 18 of adjacent modules 40 by means of fasteners such as rivets 48 and wherein an associated radially extending flange member 50 is fixed relative to the field joint plate 42 with the portion 46 of the exterior skin 18 fixed therebetween by the associated through rivet 48. The inwardly disposed portion of the radially extending flange member 15 includes a laterally extending portion 52, analogous to the portion 32 of the flange 26 and adjacent interior skin gores 30 are fixed relative to one another and the flange 50 by a through fastener 54 passing through appropriate apertures in the several elements in a manner analogous to the fastener 34.

The basic constructional module of vaulted structure in accordance with the present invention, as defined between adjacent, but spaced-apart flange members 25 and 50 and radially spaced-apart exterior and interior skin gore members 18 and 30 respectively further includes a layer of insulating material 56 such as of glass fibers adhesively secured as indicated generally at 58 to the exteriorally disposed surface of the interior skin gore 30.

Figure 2:
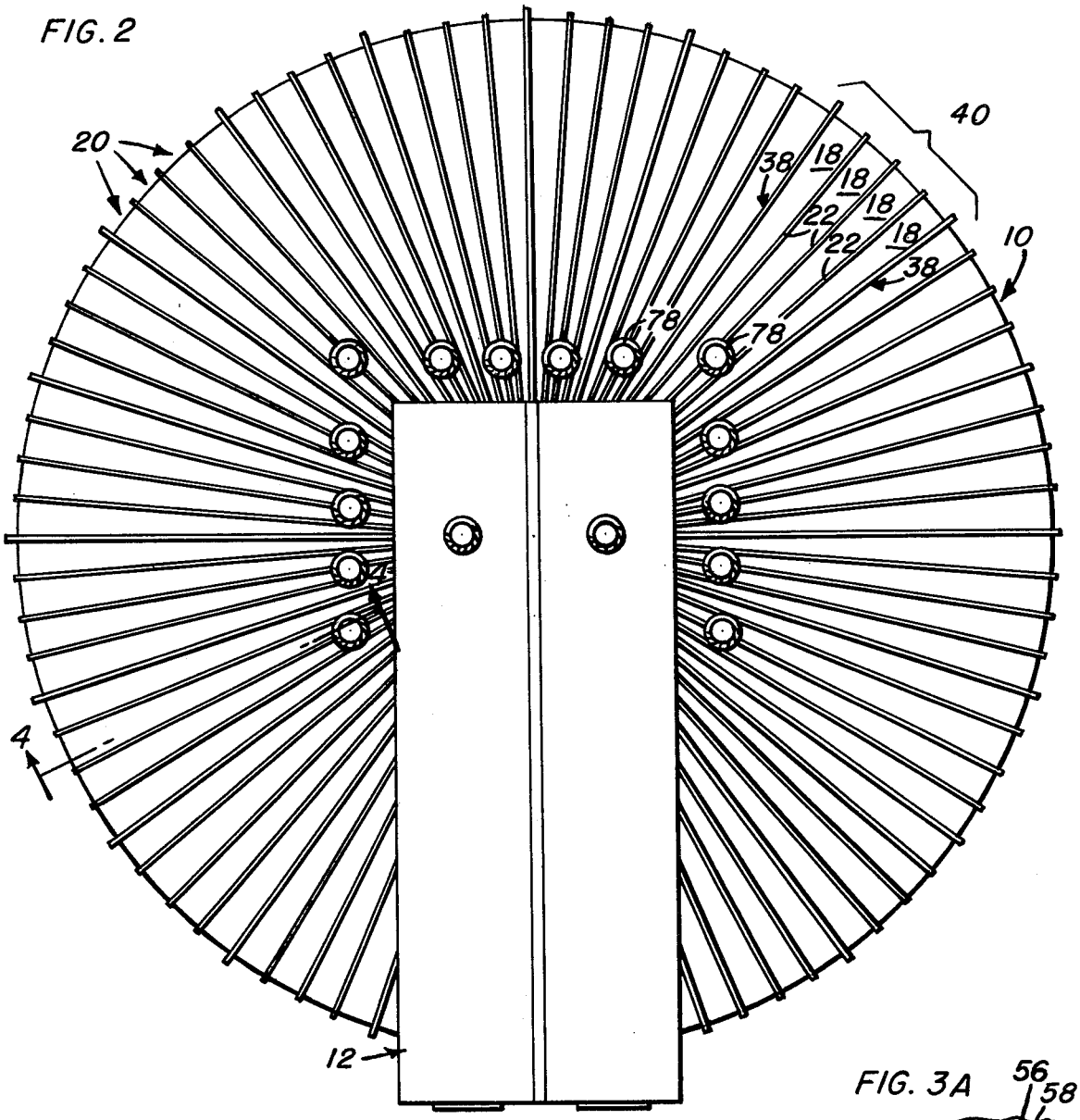
FIG. 2 is a top elevational view of the vaulted structure of FIG. 1.

The insulation 56 preferably includes an aluminum laminae 60 as is conventionally provided to enhance the insulating properties of such conventional materials. As best seen from a simultaneous consideration of FIGS. 3, 3A and 7, adjacent but spaced-apart flanges 26 and 50 are further rigidified by horizontally extending stringers 62, such as of U-shaped configuration and including apertured end tab portions 64 which horizontally disposed stringers 61 are secured to the flanges by suitable fasteners, such as rivets passing through suitable apertures in the flanges and aperture tabs as best seen in FIG. 7 and wherein the apertures in the flanges are generally indicated at 66. As best seen in FIG. 3A the insulation 56 in addition to being secured adhesively as at 58 is further secured against movement relative to the interior skin gore members 30 by being locally substantially compressed by the horizontally disposed stringers 62. It will be appreciated that the aforementioned module between adjacent spaced-apart flanges, be they adjacent spaced-apart flanges 26 between the shop joints 20 or adjacent spaced-apart flanges 26 and 50 between a shop joint 20 and a field joint 38, provides a substantially rigidified boxsection construction. In a preferred embodiment as illustrated in FIGS. 1, 2 and 4 the radially extending flanges 26 of the shop joints 20 and the radially extending field joint plate members 42 and 44 are in fact arcuate. It will be appreciated of course, that in a vaulted structure of a cloister, or A-frame configuration, the curvature of the flange members 26 and 50 and plate members 42 and 44 may vary somewhat or may even be nearly straight, as in the instance of a substantially A-frame configuration, without departing from the present invention.

Turning once again to a description of the field joints 38, and as best seen from simultaneous further consideration of FIGS. 3 and 7 the field joint plate 44 is fixedly secured to its associated outwardly turned portion 46 of an exterior skin gore 18 by fasteners 48. As will be appreciated from aforementioned U.S. Pat. No. 3,387,356 the field joint plates 42 and 44 may be secured to their associated exterior skin gore section 18 by means other than riveting, such as by welding for example. From the foregoing it will be appreciated that a plurality of modules defined between adjacent radially extending flanges will be fabricated, such as to form modules 40 which upon shipment to a construction site will be assembled such as by bolting adjacent field joint plates 42 and 44 with through bolts 70 and wherein an elastomeric bridging member 72 is interposed between the outwardly projecting portions of the field plates to provide a weather tight seal. In a preferred embodiment illustrated, the bridging member 72 is of a T configuration. With regard to the makeup of the field joint it will be appreciated that the field joint flanges 50 and the adjacent, and overlapped, interior skin gores 30 are fastened "on-site" by the fasteners 54. In this regard it will be appreciated that one of the more convenient types of fasteners to effect field or on-site makeup of the interior skin gore joints as part of the overall field joint 38 is to utilize pop rivets. Furthermore, as with all the fasteners utilized in securing the aforedescribed elements that cooperate to provide the box-section construction the fasteners will be spaced along the various elements as required depending upon the nature of the materials used and dimensions of the materials and/or vaulted structure being fabricated.

Turning specifically to FIG. 6 there are illustrated three exemplary joints of the flange 50 with the interior skin gore 30. In the left-hand view there is illustrated a construction somewhat analogous to the field joining of a flange 50 and its associated interior skin gore sections 30. For purposes of clarity, in the left-hand view the flange 50 and its associated laterally extending portions 52 and the interior gore section 30 are similarly numbered, as in FIG. 3 and other previously described figures. A thru fastener 55 is provided to fix the flange 50 and interior gore section 30 against the relative movement with the elements in face to face contact. It will be appreciated that in the event the vaulted structure 10 is formed primarily of aluminum sheet material the so joined exponents will be in thermal conductive contact along the continuous surfaces of the flange portion 52 and the interior gore section 30. In the middle view of FIG. 6 there is illustrated a modified form of the joint at the site of the field joints 38 wherein the field joint flange 50 and its associated interior skin gore 30 are joined as in the left-hand view of FIG. 6 and wherein the interior skin gore 30 extending laterally to the left of the joint is not in any manner secured to the adjacent right-hand interior skin gore 30 thereby providing a lapped interior skin gore joint adjacent the field joint 38 whereby the adjacent interior skin gore members 30 are fixed for relative sliding movements for coaction with the expansion-contraction joints of the shop joints 20 as best appreciated from the above discussion of FIG. 5. Finally, the right-hand view of FIG. 6 illustrates a modification of the interior field joint illustrated in FIG. 3 wherein a thermal barrier element 74, such as formed of a thermally non-conductive material, i.e. relatively dense closed cell polyurethane, is interposed between the laterally extending portion 52 of the flange 50 and the overlapped portion of adjacent skin gore members 30 and the assembly joined by a through rivet 57. With regard to the interior joint construction illustrated in the right-hand view of FIG. 6 it will be appreciated that such construction can in addition to being utilized adjacent the field joint flanges 50 be utilized in conjunction with the shop joint flanges 26.

Turning now to a very salient aspect of the invention it will be appreciated that by the provision of ventilation means associated with one or more of the box-section modules, ventillation can be provided to substantially the entire vaulted structure so as to provide optimum thermal conditions within the structure and more importantly coact with the aforedescribed box-section construction having expansion-contraction joint means to minimize thermal distortion of a vaulted structure constructed in accordance with the invention. In this regard, consideration of FIGS. 1, 2, 4, 8 and 9 it will be seen that in an exemplary embodiment of a generally hemispherical dome structure that ventillation louvres 76 preferably provided in each of the structural modules defined by each exterior skin gore member 18 and above the spring-line of the structure so as to not be blocked by any of the support foundation elements of the structure, coact with ventillators 78 adjacent the apex of the vaulted structure. The exteriorly disposed louvres are further shown in enlarged section in FIG. 9 and it will be appreciated from the exemplary showing of the ventillators 78 that they are of the wind driven turbine type. As seen in FIG. 8 when considered together with FIG. 4 the interior of the vaulted structure may be similarly ventillated by the provision of interior ventillation louvres indicated generally at 80 and wherein portions of the insulation 56 adjacent the louvres so provided in the interior skin gores 30 is removed to permit the free passage of air upwardly through the modules to the ventillators 78 adjacent the apex. It will be appreciated that the void indicated generally at 82 that exists between each pair of radially extending flanges 26 and 50 or 26 and 26 and their associated exterior and interior sking gore sections 18 and 30 respectively is further communicated by apertures 84 in the respective flanges 26 and 50, which apertures 84 place the voids 82 in substantial communication for substantially uniform ventillation, as by the gravity in the embodiment illustrated, to establish a general uniform temperature gradient throughout the vaulted structure. As seen best in FIGS. 1 and 2, the shutters of the exemplary observatory dome structure 10 illustrated are provided with louvre means 86 and ventillator means 88 in a manner analogous to the aforedescribed louvres and ventillators for substantially the same reasons set forth with regard thereto. As best seen in FIG. 2 it is not generally necessary to provide a ventillator 78 adjacent the apex of each box-section module defining a void 82 by virtue of the provision of the apertures 84 in the radially extending flange members 26 and 50 since air entering the louvre means 76 or 80 of a plurality of the box-section modules can comingle and pass upwardly and outwardly through a single ventillator 78. In this regard, however, it will be appreciated that it is preferable to provide a sufficient number of ventillators 78 adjacent the apex of the vaulted structure so as to maximize gravity air flow through the box-section construction to achieve the maximum benefit derived from the construction disclosed herein.

An exemplary embodiment of a preferred support means for a vaulted structure constructed in accordance with the invention is indicated generally at 90 in FIGS. 10 and 11 for assisting in transferring stress of the box-section modules to a tension ring adjacent the spring-line region 14 of the structure as indicated generally in FIGS. 1 and 4. In FIG. 1 it will be seen that a tension ring means is provided by a horizontally disposed generally I-shaped member indicated at 92 which is generally continuous around the inner perimeter of the structure and is fixed thereto by conventional means, e.g., welding, riviting etc., not shown.

In the embodiment of FIGS. 10 and 11, the tension ring is a generally continuous bond of a generally right angle cross section comprising an annular horizontally disposed bond 94 and an annular vertically disposed bond 96 fixedly secured at 98, such as by welding for example. A generally continuous vertically disposed bond 100 is fixedly secured to the horizontal bond 94, preferably by welding, as at 102. The bond 100 is secured to the interior skin gore members 30 of the box-section modules, such as by rivets 104. The bond 94 is secured to the exterior skin gore sections 19, such as by bolts 108, for example. The described support means 90, and particularly the bond member 100, provides an extremely strong attach point to the interior skin of the structure and can transfer stresses of the box-section modules to the tension ring more efficiently than the tension ring means 92. The vertical standard 106, such as of pipe, merely comprises a portion of a support base analogous to that indicated generally at 16 in FIGS. 1 and 4.

It will be appreciated that the members comprising the support means 90, or for that matter the means 92, will in the instance where a structure is fabricated in "the shop" and then disassembled for shipment and reassembly, be severed at spaced points, such as at the field joints 38. The support means members will in such a case be rejoined, such as by bolted plates, for example, to maintain the continuous nature of the respective elements around the perimeter of the structure.

What is claimed is:

1. A vaulted structure having a base portion and an apex portion comprising a plurality of box-section modules means secured to form the structure, said box-section modules comprising adjacent spaced-apart exterior and interior skin gore members and at least a pair of spaced-apart generally radially extending flange members securing said gore members in spaced-apart relation and defining a ventilation void therebetween, at least some of said exterior gore members having outwardly turned edge portions, joint means for providing for expansion-contraction between at least some of said plurality of box-section modules, said joint means comprising at least a portion of one of said pair of spaced-apart radially extending flange members being interposed between and secured to said outwardly turned portions of two adjacent exterior gore members, and ventilation means for providing at least gravity flow of air through said ventilation void of at least some of said plurality of box-section modules for coaction with said joint means for minimizing thermal distortion of the vaulted structure.

2. The combination of claim 1 wherein the structure is in the form of a generally hemispherical dome.

3. The combination of claim 1 wherein the structure is in the general form of a cloister.

4. The combination of claim 1 wherein said box-section module means is provided with insulation means for minimizing the transmission of heat and sound from said exterior skin gore members to said interior skin gore members.

5. The combination of claim 4 wherein a layer of thermal and sound insulating material is generally coextensive and contiguous with at least some of the interior skin gore members on an exteriorly disposed face thereof.

6. The combination of claim 1 wherein said box-section modules include a plurality of generally horizontally extending members having opposed ends secured to at least some of said at least a pair of spaced-apart flange members.

7. The combination of claim 5 wherein said insulating material is adhesively secured to an exteriorly disposed face of said interior skin gore members.

8. The combination of claim 6 wherein said plurality of generally horizontally extending members are secured to said flange members to compressively secure a layer of thermal and sound insulating material in contiguous relation to an exteriorly disposed face of at least some of the interior skin gore members.

9. The combination of claim 1 including means for assisting in transferring stress of the plurality of box-section module means forming the vaulted structure to a supporting foundation, said stress transferring means comprising a generally vertically disposed horizontally extending continuous member fixedly secured to said interior skin gore members adjacent said base portion.

10. The combination of claim 9 wherein said stress transferring means further includes at least a generally horizontally disposed, horizontally extending member generally disposed adjacent and beneath said spaced-apart exterior and interior skin gore members with said vertically disposed continuous member fixedly secured thereto.

11. The combination of claim 10 wherein said stress transferring means further includes a second vertically disposed horizontally extending continuous member fixedly secured to the interior of said exterior skin gore member and said horizontally extending member in downwardly disposed relation to said horizontally extending member.

12. A vaulted structure having a base portion and an apex portion comprising a plurality of box-section module means secured to form the structure, said box-section modules comprising adjacent spaced-apart exterior and interior skin gore members and at least a pair of spaced-apart generally radially extending flange members securing said gore members in spaced-apart relation and defining a ventilation void therebetween, joint means for providing for expansion-contraction between at least some of said plurality of box-section modules, and ventilation means for providing at least gravity flow of air through said ventilation void of at least some of said plurality of box-section modules for coaction with said joint means for minimizing thermal distortion of the vaulted structure, said box-section modules including a plurality of generally horizontally extending members having opposed ends secured to at least some of said at least a pair of spaced-apart flange members, and said plurality of generally horizontally extending members being secured to said flange members to compressively secure a layer of thermal and sound insulating material in contiguous relation to an exteriorly disposed face of at least some of the interior skin gore members.

13. A vaulted structure having a base portion and an apex portion comprising a plurality of box-section module means secured to form the structure, said box-section modules comprising adjacent spaced-apart exterior and interior skin gore members and at least a pair of spaced-apart generally radially extending flange members securing said gore members in spaced-apart relation and defining a ventilation void therebetween, joint means for providing for expansion-contraction between at least some of said plurality of box-section modules, and ventilation means for providing at least gravity flow of air through said ventilation void of at least some of said plurality of box-section modules for coaction with said joint means for minimizing thermal distortion of the vaulted structure, means for assisting in transferring stress of the plurality of box-section module means forming the vaulted structure to a supporting foundation, said stress transferring means comprising a generally vertically disposed horizontally extending continuous member fixedly secured to said interior skin gore members adjacent said base portion, said stress transferring means including at least a first generally horizontally disposed, horizontally extending member generally disposed adjacent and beneath said spaced-apart exterior and interior skin gore members with said vertically disposed continuous member fixedly secured thereto, and said stress transferring means further including a second vertically disposed horizontally extending continuous member fixedly secured to the interior of said exterior skin gore member and said horizontally extending member in downwardly disposed relation to said horizontally extending member.

* * * * *